US008732985B2

(12) United States Patent
Zanatta et al.

(10) Patent No.: US 8,732,985 B2
(45) Date of Patent: May 27, 2014

(54) SHOE WITH BREATHABLE SOLE

(75) Inventors: Marco Zanatta, Nervesa della Battaglia (IT); Giovanni Martini, Nervesa della Battaglia (IT); Lino Bernardel, Nervesa della Battaglia (IT)

(73) Assignee: W. L. Gore & Associates GmbH, Putzbrunn (DE)

( * ) Notice: Subject to any disclaimer, the term of this patent is extended or adjusted under 35 U.S.C. 154(b) by 1123 days.

(21) Appl. No.: 11/917,178

(22) PCT Filed: Jun. 1, 2006

(86) PCT No.: PCT/EP2006/062839

§ 371 (c)(1),
(2), (4) Date: Dec. 11, 2007

(87) PCT Pub. No.: WO2006/134033

PCT Pub. Date: Dec. 21, 2006

(65) Prior Publication Data

US 2008/0196278 A1 Aug. 21, 2008

(30) Foreign Application Priority Data

Jun. 15, 2005 (IT) ..... TV2005A0084

(51) Int. Cl.

| | |
|---|---|
| ***A43B 13/20*** | (2006.01) |
| ***A43B 7/06*** | (2006.01) |
| ***A43B 7/08*** | (2006.01) |
| ***A43B 21/28*** | (2006.01) |

(52) U.S. Cl.
USPC ..... 36/29; 36/3 B; 36/3 R; 36/35 B; 36/147

(58) Field of Classification Search
USPC ..... 36/3 A, 3 R, 3 B, 43, 44, 29, 30 R, 30 A, 36/35 B, 145, 147, 3
See application file for complete search history.

(56) References Cited

U.S. PATENT DOCUMENTS 4,507,880 A * 4/1985 Ohashi ..... 36/115
5,992,052 A * 11/1999 Moretti ..... 36/3 B (Continued)

FOREIGN PATENT DOCUMENTS

DE 202004008539 9/2004
DE 202004000307 10/2004

(Continued)

OTHER PUBLICATIONS

Machine Translation for DE 202004000307.*

(Continued)

*Primary Examiner* — Jila M Mohandesi
*Assistant Examiner* — Tiffany Drake
(74) *Attorney, Agent, or Firm* — Katten Muchin Rosenman LLP

(57) ABSTRACT

Sole (100; 200; 300; 400) comprising a support layer (101; 201; 301; 401) having at least one region (103; 203; 303; 403) which allows the passage of air through said layer (101; 201; 301; 401), characterized in that it comprises one or more reinforcing elements (111; 211, 311; 411) joined to one side of said layer (101; 201; 301; 401) in said at least one region (103; 203; 303, 403) and perforated with through-openings (113; 213; 313; 413) for evacuating the air which passes through said region; and a membrane (117; 290, 390; 417) made of material which is waterproof and vapor-permeable, situated above said at least one region (103; 203; 303, 403) on the side of said layer (101; 201; 301, 401) opposite to said elements (111; 211, 311; 411) and sealed with said layer (101; 201; 301; 401) at least along one contour (115; 215; 305) around said at least one region (103; 203; 303; 403).

20 Claims, 11 Drawing Sheets

(56) References Cited

U.S. PATENT DOCUMENTS

| | | | | |
|---|---|---|---|---|
| 6,408,541 | B1 * | 6/2002 | Moretti | 36/12 |
| 7,178,266 | B2 * | 2/2007 | Deem et al. | 36/3 B |
| 7,328,524 | B2 * | 2/2008 | Lebo | 36/3 R |
| 7,559,157 | B2 | 7/2009 | Polegato Moretti | |
| 2001/0010127 | A1 | 8/2001 | Polegato Moretti | |
| 2002/0017036 | A1 | 2/2002 | Berger et al. | |
| 2002/0100187 | A1 * | 8/2002 | Polegato | 36/3 R |
| 2003/0136023 | A1 * | 7/2003 | Chen | 36/3 R |
| 2004/0035022 | A1 | 2/2004 | Polegato Moretti | |
| 2004/0074107 | A1 * | 4/2004 | Tuan | 36/3 R |
| 2005/0126036 | A1 | 6/2005 | Wu | |
| 2005/0229431 | A1 | 10/2005 | Gerlin | |
| 2006/0096123 | A1 * | 5/2006 | Grandini | 36/3 B |
| 2006/0162183 | A1 * | 7/2006 | Polegato Moretti | 36/3 B |
| 2007/0011907 | A1 | 1/2007 | Polegato Moretti | |
| 2008/0196278 | A1 | 8/2008 | Zanatta et al. | |

FOREIGN PATENT DOCUMENTS

| | | |
|---|---|---|
| DE | 20 2004 000 307 | 11/2004 |
| EP | 0 576 734 | 1/1994 |
| EP | 1 127 505 | 8/2001 |
| EP | 1089642 | 1/2004 |
| EP | 1586248 | 10/2005 |
| ES | 1019098 | 3/1992 |
| GB | 149 616 | 10/1921 |
| GB | 2 114 425 | 8/1983 |
| GB | 2 264 626 | 9/1993 |
| IT | PD20030166 | 1/2005 |
| RU | 2 401 623 | 10/2010 |
| WO | 9851177 | 11/1998 |
| WO | 0214326 | 2/2002 |
| WO | 0232246 | 4/2002 |
| WO | 2004028284 | 4/2004 |
| WO | 2005/011417 | 2/2005 |
| WO | 2005/065479 | 7/2005 |
| WO | 2005065479 | 7/2005 |

OTHER PUBLICATIONS

Written Opinion of the International Searching Authority and International Search Report dated Jul. 27, 2006 for the corresponding International Application PCT/EP2006/062839.

Argentinian Office Action, from corresponding Argentinian Application No. P060102550.

* cited by examiner

SHOE WITH BREATHABLE SOLE

BACKGROUND OF THE INVENTION

1. Field of the Invention

The present invention relates to a shoe with a breathable sole.

2. Description of the Related Art

It is known that, in order to ensure hygienic and comfortable conditions for the feet, a shoe should not trap the products of perspiration (moisture and water vapour) but, on the contrary, should prevent stagnation thereof. This requirement is all the greater if the foot is subject to overheating or to stresses (for example sporting activities). Obviously the strength and the protection provided by the shoe must not be compromised in the attempt to make a shoe breathable.

Many solutions which aim to obtain a shoe which is both breathable as well as comfortable and safe are known. Patent application WO 04/028284 describes a sole comprising:

a support layer which in at least one macro-portion is made of "perforated" material;

a breathable membrane associated on top of the support layer at least in the macro-portion;

a tread made of plastic material with a macro-perforation at least at the macro-portion, the tread being joined hermetically to the membrane and to the support layer at least along the perimeter of the macro-portion.

The patent application WO 02/32246 attempts to solve the technical problem whereby, in a sole comprising a layer of felt to which a breathable membrane is joined, the latter tears because it is not sufficiently elastic with respect to the felt layer. The solution consists in providing an inner sole which has a layer preventing elongation of the felt situated underneath the membrane. These three layers are provided in sandwich form and communicate with the exterior by means of holes formed in the tread of the shoe.

In patent application WO 98/51177 the technical problem is that of improving the process for manufacturing a breathable shoe and ensuring that the associated breathable membrane is protected from mechanical stresses. A tread is provided with perforations and is in contact with an insole which comprises a membrane associated above a protective layer so as to form a stratified or sandwich structure. The insole is pre-moulded and assembled with the tread using glue or by means of overinjection.

In patent EP 1,089,642 the technical problem is that of increasing the circulation (otherwise poor) of air inside the shoes, while protecting the breathable membrane which renders the shoe breathable. It is considered that the poor circulation is due to the small number of perforations in the shoe with respect to its surface area, so that the solution proposed is a sole with an integrated tread in which raised vertical projections in an empty region are in contact with a protective layer on top of which a membrane is associated. The empty region communicates with the exterior of the shoe via numerous horizontal channels.

In the patent application WO 02/14326 the technical problem is to provide a breathable shoe. This patent describes a shoe which has an insole comprising a membrane associated with an underlying protective layer in turn joined to a perforated tread, all of which with a sandwich structure. A perforated filling layer or "filler" is arranged on the membrane. By way of a variation of assembly, the edges of the membrane may be also joined directly to the tread.

All these solutions have intrinsic disadvantages. The sandwich structure which includes the breathable membrane is commonly fixed to the remainder of the shoe by means of overinjection of plastic material which forms the tread. There is therefore the risk of damaging the membrane which per se is very delicate and does not withstand very well the aggressive action of the melted plastic material. Another very important disadvantage is that the expulsion of the moisture from inside the shoe through the membrane may take place only naturally, namely that the moisture must pass through the membrane spontaneously. This is a very slow natural process; a forced process which increases the efficiency thereof would be advantageous.

SUMMARY OF THE INVENTION

Also know is US 2001/0010127, wherein there is disclosed a sole with a breathable membrane laid on a support layer which is perforated in a region under the membrane and is reinforced by vertical hollow inserts. The membrane rests at the same level of the sole and is disclosed as strictly tensioned.

The object of the present invention is to provide a shoe with a breathable sole devoid of the problems and drawbacks mentioned above briefly.

This object is achieved with a sole for a waterproof and breathable shoe.

As will be clarified more fully below, a sole according to the invention has mainly these advantages:

the waterproof membrane is sealed onto sole elements after joining of the reinforcing elements (preferably by means of overinjection) has been performed; all the problems resulting from the high temperature of the melted material and/or those associated with handling of the membrane are therefore eliminated;

sealing the membrane covering said region along a contour around said region and advantageously raising slightly the membrane from the region enables the formation of an air chamber (i.e. an empty space above said region) which is periodically compressed and expanded by the movement of the foot; this oscillating action causes pumping of the moist air out of the shoe, improving the breathability of the said shoe; the pumping effect is obtained even if the membrane is not raised from the edge of the said region (namely with smaller dimensions of the air chamber), but only extends over it in an untensioned state; in this case a movement of the foot is sufficient to cause oscillation of the membrane and create the pumping effect.

A support element is understood generally as being a membrane support element which may be in contact with the ground and may therefore also be stratified or comprise various sub-elements, such as a mounting insole, a tread sole or the two together.

The membrane, which is sealed on the support layer, is advantageously sealed on said support layer at least along a contour outside said region. This allows either an increase in the dimensions of the air chamber or in any case an increase in the amount of movement which the membrane is able to perform, since its unconstrained surface area increases. In some case, for constructional reasons, it is possible to fix the membrane at certain points along said region (for example in shoes used in extreme activities, where the foot movements are considerable and the membrane could perform uncontrollable oscillating movements). Even though the mobility of the membrane is limited in this case, every free portion thereof nevertheless acts as a pumping surface.

The reinforcing elements strengthen either the said region through which the air is able to pass or the overall structure of the sole, or both.

The said region which allows the passage of the air through said support layer may have channels for allowing the air to pass through. Said region may also have, advantageously associated with it, a material which allows the passage of the air, for example a meshwork fabric or a membrane made of a material which is waterproof and vapour-permeable. In this way the water tightness and the robustness (and strength) of the sole is advantageously improved.

BRIEF DESCRIPTION OF THE DRAWINGS

The advantages of the invention will emerge more clearly from the following description of a preferred embodiment of the invention, provided by way of example and with reference to the accompanying drawings, in which.

DETAILED DESCRIPTION OF THE INVENTION

Figures 1, 2, 3, 4:
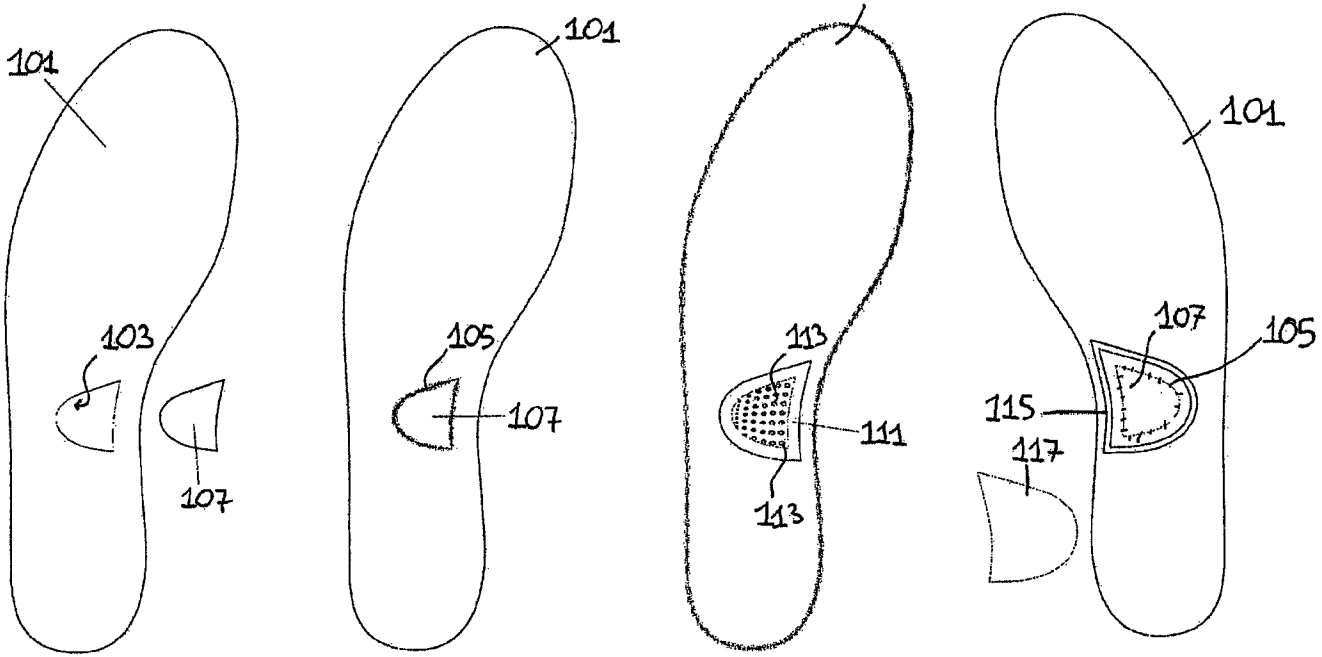
FIGS. 1 to 7 illustrate the steps for manufacturing a first embodiment of the sole and therefore the shoe according to the invention.
Figure 7:
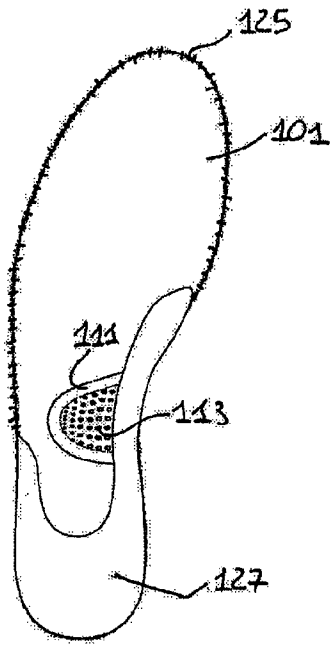
Figure 6:
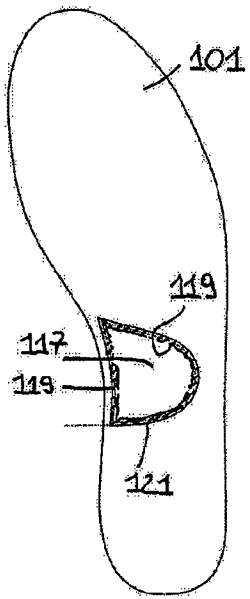
Figure 5:
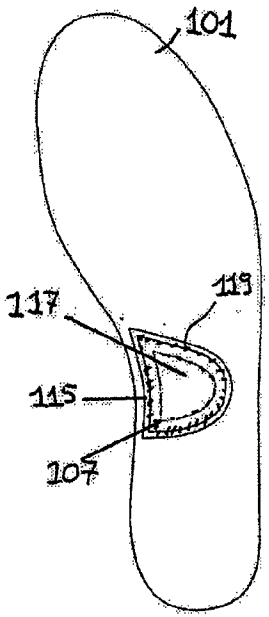
Figure 8:
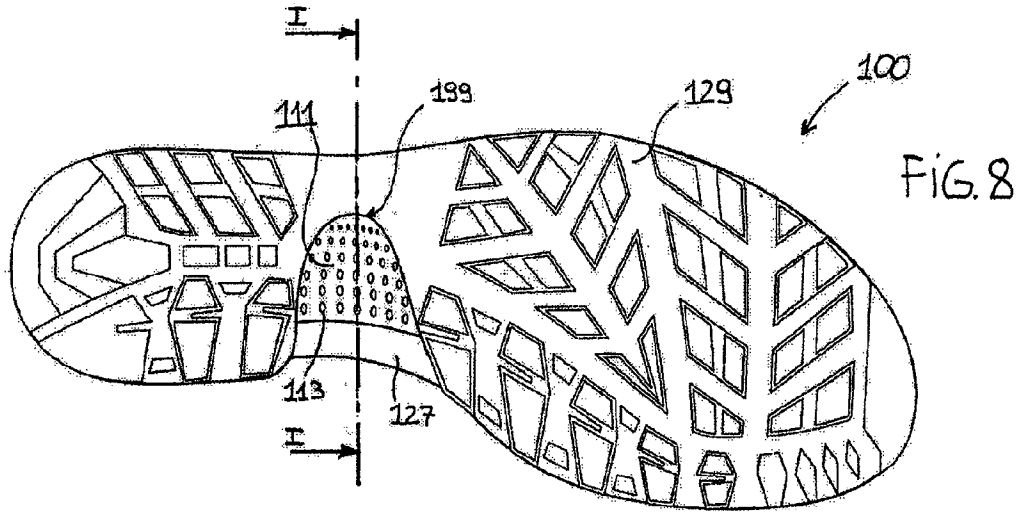
FIG. 8 shows a plan view, from below, of the finished sole according to FIG. 1.
Figure 9:
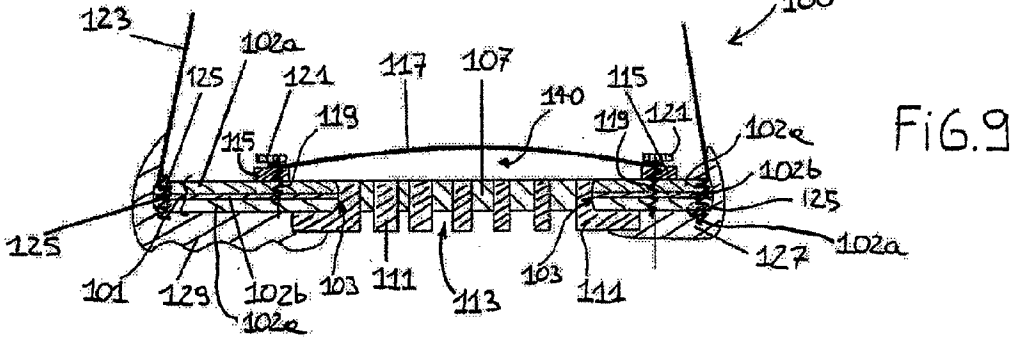
FIG. 9 shows a cross-sectional view along the plane I-I of the sole according to FIG. 8 and part of the associated shoe.

FIGS. 1 to 7 illustrate in schematic form the main steps for manufacturing a breathable and waterproof sole for a shoe according to the invention, which is shown in FIG. 8 and FIG. 9 after completion of processing, denoted by 100, as well the subsequent manufacture of a shoe (shown only partially) with such a sole. These steps, indicated by a1-a9, are as follows:

a1) a mounting insole 101 (see FIG. 1 and also FIG. 9) is composed of a sandwich consisting of a first water-repellent material 102*a* (e.g. ordinary felt which does not "draw" the water), an aluminium film 102*b* and a second layer of water-repellent material 102*a* (identical to the first layer). The (optional) aluminium layer 102*b* is useful for preserving heat and acting as an insulator; the insole 101 could, for example, consist of a single layer of felt; the insole 101 moreover has, formed therein, at least one central window (or through-opening) 103 for example formed by means of punching;

a2) a permeable fabric 107, for example a meshwork fabric, with dimensions corresponding to or also greater than those of the window is fixed, preferably by means of a perimetral stitch 105, in the window 103 of the insole 101 (see FIG. 2);

a3) an overinjection of thermoplastic material is performed onto the meshwork fabric 107 (see FIG. 3) on the side facing the ground, in order to form a perforated reinforcing element 111 having at least one, but preferably several holes or vertical openings 113 (only some are indicated by the reference number for the sake of simplicity); said holes 113 let the fabric 107 communicate with the exterior; the element 111 has greater dimensions than the surface of the meshwork fabric 107 and passes through its entire thickness, covering and sealing also the stitching 105;

a4) a second overinjection of thermoplastic material is performed (FIG. 4) in the part of the mounting insole opposite the element 111, i.e. that facing the foot, so as to obtain a rim (or frame) 115 which surrounds said meshwork fabric 107;

a5) a portion of the membrane 117 made of material which is waterproof and vapour-permeable is cut out, said membrane having an extension equal to or greater than the rim 115 and being fixed thereto by means of a perimetral stitching 119 (FIG. 5);

a6) the stitching 119 is covered (FIG. 6) with a special tape 121 compatible with the underlying rim 115 by means of heat-welding or high-frequency welding; the tape is welded perfectly to the edge of the membrane 117, without damaging it, and to the rim 115, joining them together with a waterproof seal;

a7) the insole 101 thus manufactured is applied to an upper 123 (see FIG. 9) by means of a perimetral stitch 125 (which can be seen in FIG. 7);

a8) a covering element 127, formed by means of injection inside a separate mould, is applied onto the insole 101 so as to cover/protect at least a part of the perimetral stitching 125;

a9) a tread sole 129 is applied to the insole 101, using glues or by means of direct injection onto the upper; the sole 129 comprises an recess zone 199 which surrounds partly the element 111.

The user's foot rests, preferably also by means of an inner sole (not shown), on the membrane 117. Any outer water, with which the sole 100 of the shoe comes into contact, is stopped by the membrane 117 and by the felt 102*a*, which may at the most become soaked superficially (namely a few millimeters). In order to avoid also this minimum absorption it is possible to use felt covered by polyurethane film.

It should be noted how the sole structure according to the invention produces a very advantageous effect. Since the membrane 117 is situated above a support which has at least one region 107 in communication with the exterior (namely downwards through the openings 113) and is joined to said support layer at least along a contour which surrounds said region (the rim 115 in the example described), the membrane 117 is not constrained—as in the sandwich structures according to the prior art—such that it adheres to the breathable layer 107. Therefore, the movement of the foot favours a vertical oscillation of the membrane 117, which is also favoured by an air chamber 140 which is created between the latter and the breathable layer 107 (see FIG. 9), and this causes pumping of the air out from the sole 100 of the shoe. This air conveys outside the moisture present inside the shoe and produced for example by sweating of the foot. Obviously this moist air pumping action significantly improves the comfort of the shoe with the sole 100 compared to conventional shoes. It is also possible to insert inside the chamber 140 a cushion of spongy material (for example expanded polyurethane with large open pores) which favours the pumping action.

The membrane 117 is applied to the insole 101 after overinjection of the element 111 has been performed and therefore is not subject to the risk of deterioration caused by the high temperature during the injection step. The local application of the tape 121 onto the edge of the membrane 117 is a process which does not involve any risk of damaging the membrane 117, since the tape is compatible with the said membrane 117. Maximum insulation against water penetration is achieved as well as a certain elasticity between the membrane 117 and the rim 115 which, in the case where the chamber 140 is occupied by a breathable cushion (not shown) in order to improve the comfort, ensures a slight degree of yielding along the perimeter of the membrane 117 which does not risk tearing.

Figure 12:
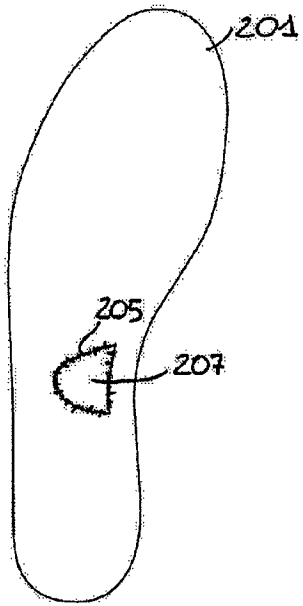
FIGS. 10 to 15 illustrate the steps for manufacturing a second embodiment of the sole and therefore the shoe according to the invention.
Figure 11:
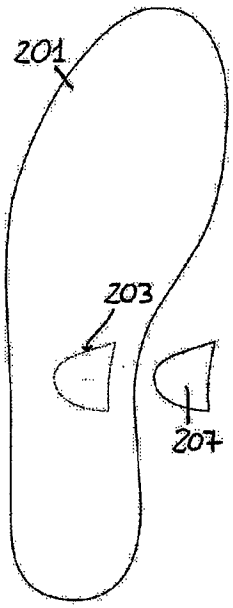
Figure 10:
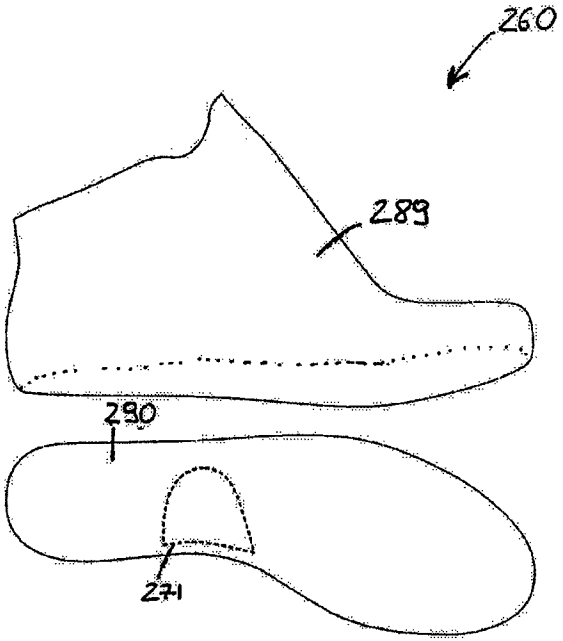
Figure 15:
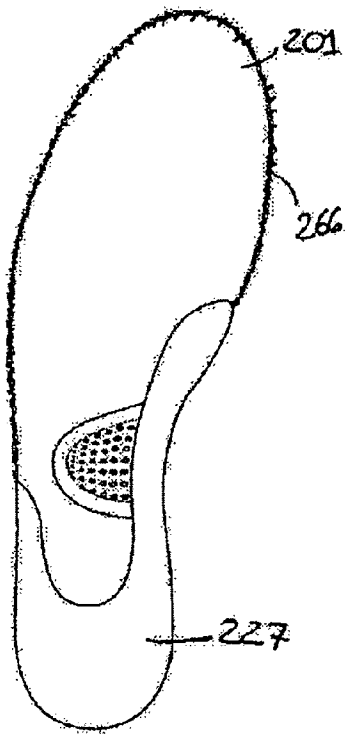
Figure 14:
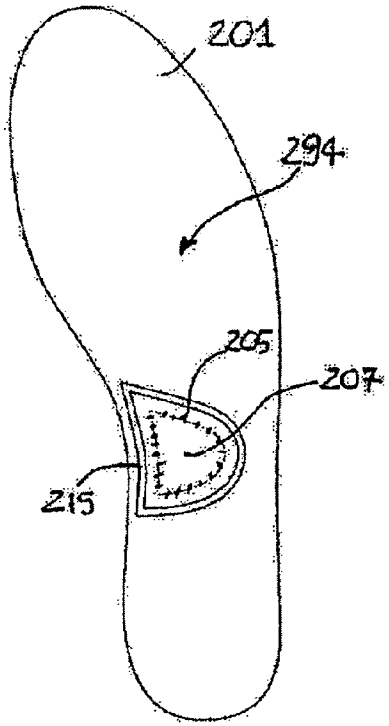
Figure 13:
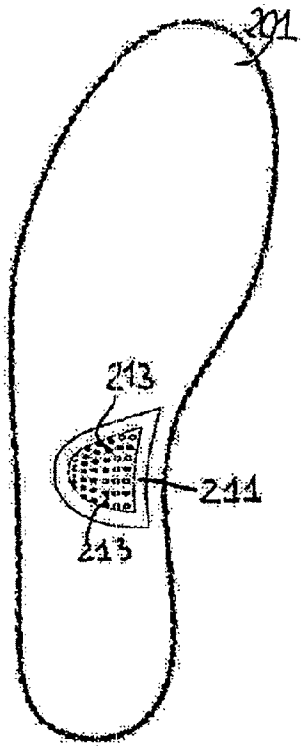
Figure 16:
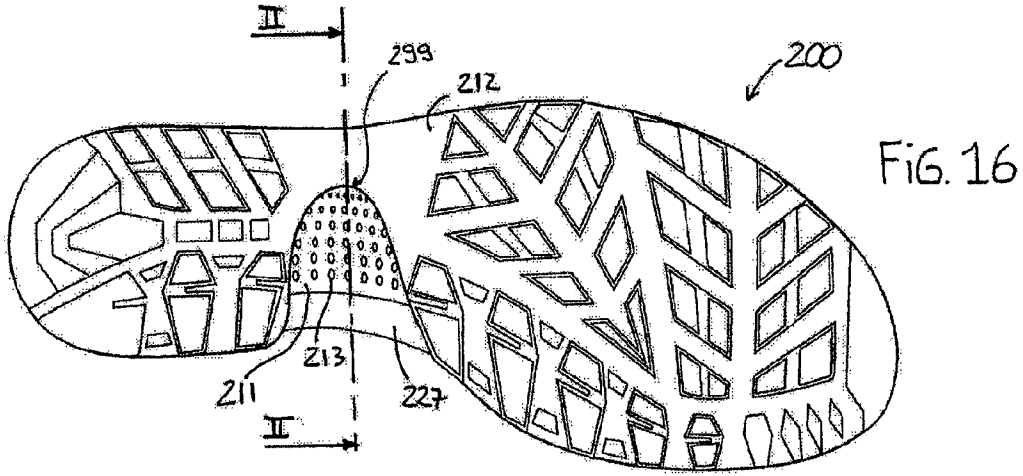
FIG. 16 shows a plan view from below of the second sole finished.
Figure 17:
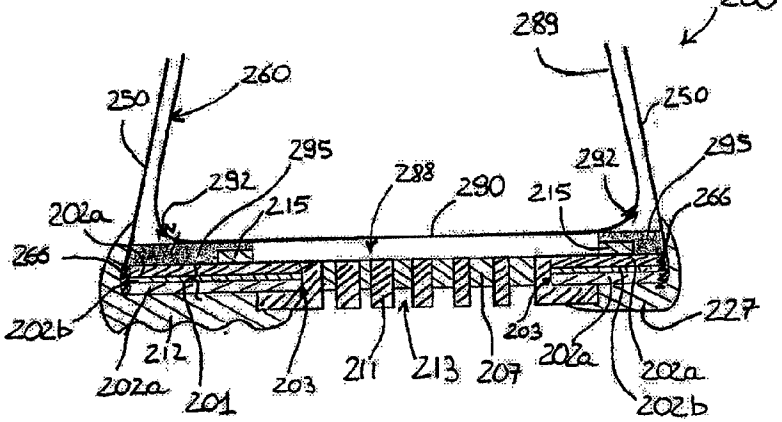
FIG. 17 shows a cross-sectional view along the plane II-II of the sole according to FIG. 16 and of part of the associated shoe.

FIGS. 10 to 15 show the main steps for the manufacture of a second sole according to the invention which is shown in FIG. 16 and FIG. 17 after completion of processing, denoted by 200, as well the subsequent manufacture of a shoe (shown only partially) with such a sole. These steps, indicated by b1-b10, are as follows:

b1) a mounting insole 201 (see FIG. 11 and also FIG. 17) is composed of a sandwich consisting of a first water-repellent material 202*a* (e.g. ordinary felt which does not "draw" the water), an aluminium film 202*b* and a second layer of water-repellent material 202*a* (identical to the first layer); the same comments made for the layers 102*a* and 102*b* are applicable for the layer 202*a* and 202*b*; the insole 201 has, moreover, formed therein, at least one central window (or opening) 203 for example formed by means of punching;

b2) a water and air permeable fabric 207, for example a meshwork fabric, with corresponding or also slightly greater dimensions is fixed, by means of a perimetral stitch 205 (or other system, for example by high-frequency welding), at the window 203 of the insole 201 (see FIG. 12);

b3) an overinjection of thermoplastic material is performed onto the meshwork fabric 207 (see FIG. 13) on the side facing the ground, in order to form a perforated reinforcing element 211 having at least one and preferably several holes or vertical openings 213 (only some are indicated by the reference number for the sake of simplicity); said holes 213 connect the fabric 207 to the exterior; the element 211 has greater dimensions than the surface of the meshwork fabric 207 and passes through its entire thickness, covering and sealing also the stitching 205;

b4) a second overinjection of thermoplastic material is performed (FIG. 14) in the part of the mounting insole 201 opposite the element 211, i.e. that part facing the foot, so as to obtain a rim (or frame) 215 which surrounds said meshwork fabric 207;

b5) the insole 201 thus formed is applied to an upper 250 by means of a perimetral stitching 266 (see FIG. 17);

b6) a tubular stocking 260 is prepared (see FIG. 10) using an impermeable and breathable membrane having characteristics identical to those of the membrane 107; the stocking 260 comprises an upper part 289 enveloping the upper part of the foot and a second insole part 290; the two parts 289, 290 are stitched together so as to form the stocking 260 by means of stitches 292 which are then heat-welded in order to prevent water infiltration;

b7) the surface 294 of the mounting insole 201 facing the foot is covered with glue 295, except for the area comprised by the element 215 (see FIG. 14 and FIG. 17);

b8) the bottom zone of the tubular stocking 260 in the region of the insole 290 is covered with glue, except for the area indicated by 271 in FIG. 10 (shown in broken lines), said area corresponding substantially to the area delimited by the element 215 on the insole 201; the stocking 260 and the insole 201 are then glued together;

b9) the tubular stocking 260 consisting of the membrane is applied to the upper 250 by means a perimetral stitching (not shown) in the zone of the collar;

b10) an element 227 made of plastic material obtained by means of injection in a separate mould, is applied onto the insole 201 so as to cover/protect at least a part of the perimetral stitching 266 and a tread sole 212 is applied; the sole 212 comprises a recess zone 299 which surrounds partially the element 111.

As in the preceding variant, the user's foot rests, preferably also by means of an inner sole (not shown), on the part 290 of the stocking 260 made of membrane material. The penetration of water from outside the shoe with a sole 200 is stopped by the membrane of the part 290 and the glue 295.

It should be noted how the structure of the sole 200 according to the invention produces the effect of pumping the moist air outside the shoe, as already described with reference to the membrane 117, owing to the fact that the membrane in the part 290 is not attached to the fabric 207 and is able to oscillate inside an air chamber 288 above said layer of fabric 207.

Moreover, the impermeable and breathable membrane is applied to the insole 201 after overinjection of the element 211 has been performed and therefore does not risk being damaged by the high temperature during the injection step. The various gluing steps may be performed by means of spot gluing (spiderweb technique) or spray gluing, so as to reduce to a minimum the risk of damaging the membrane.

Figure 20:
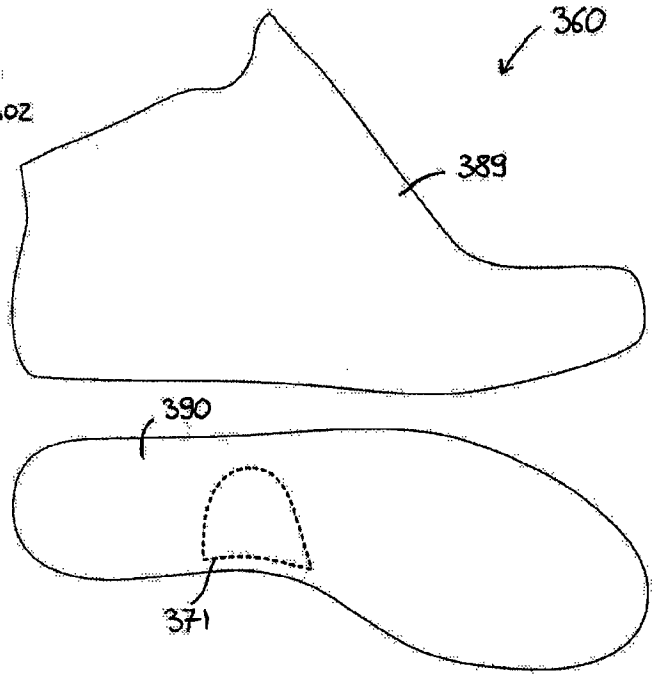
Figure 19:
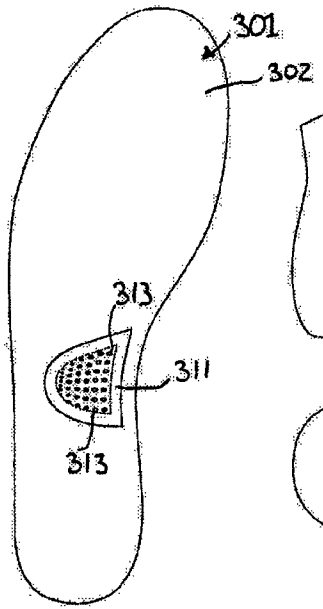
FIGS. 18, 19, 21, and 22 illustrate the steps for manufacturing a third embodiment of the sole according to the invention.
Figure 18:
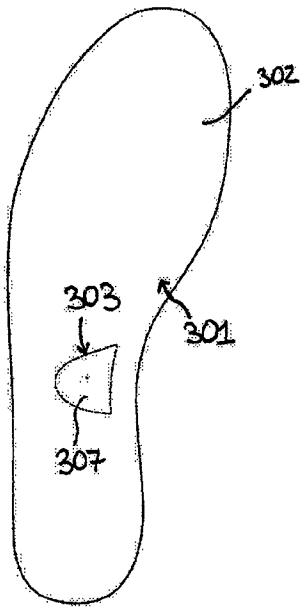
Figure 22:
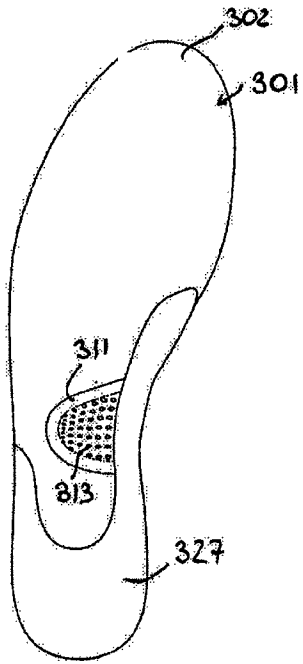
Figure 21:
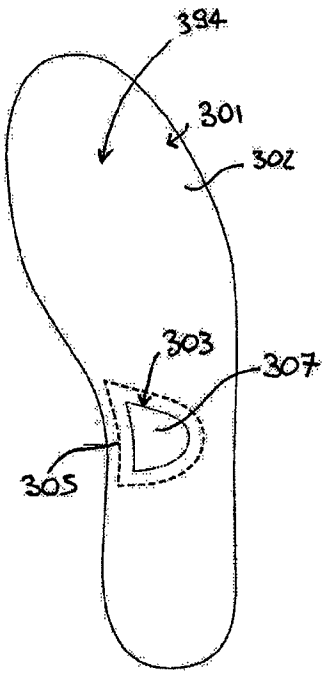
Figure 23:
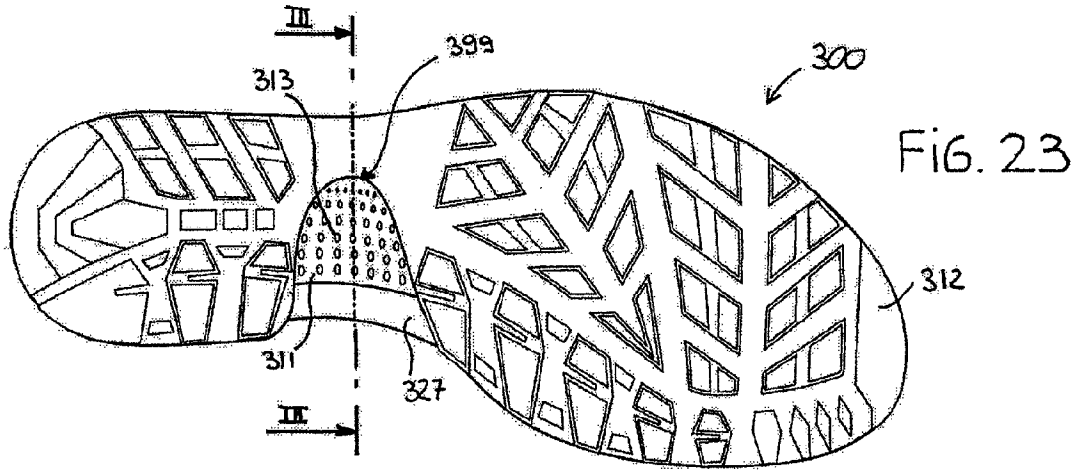
FIG. 23 shows a plan view, from below, of the third sole finished.
Figure 24:
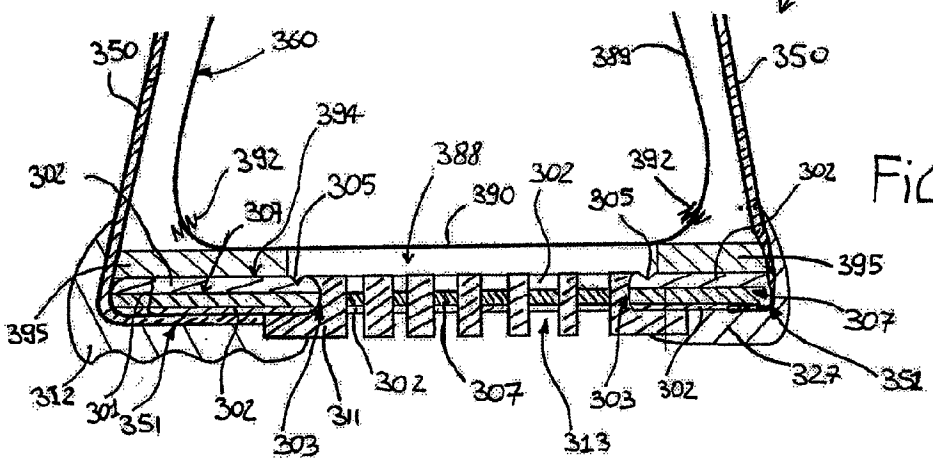
FIG. 24 shows a cross-sectional view along the plane III-III of the sole according to FIG. 23 and of part of the associated shoe.

FIGS. 18 to 22 show the main steps for the manufacture of a third sole according to the invention which is shown in FIG. 23 and FIG. 24 after completion of processing, denoted by 300, as well the subsequent manufacture of a shoe (shown only partially) with such a sole. These steps, indicated by c1-c8, are as follows:

c1) a mounting insole 301 (see FIG. 18) is obtained by injecting thermoplastic material 302 over a meshwork fabric 307, using a method which the Applicant has described in European patent EP 697,957; on the insole 301 overinjection is not performed in at least one central window (or opening) 303; in this way, in the region where overinjection has not been performed, the underlying meshwork fabric 307 is left exposed (a solution involving the formation of a region comprising several small holes or a grid is also possible, for example); dearly it is possible to provide more than one window also with different shapes;

c2) an overinjection of thermoplastic material is performed in the exposed zone of meshwork fabric 307 (see FIG. 19) on the side of the insole 301 facing the ground, so as to form a perforated reinforcing element 311 having at least one and preferably several holes or vertical openings 313 (only some are indicated by the reference number for the sake of simplicity); said holes 313 let the fabric 207 communicate with the exterior; the element 311 has greater dimensions than the window 303 of meshwork fabric 307 and passes through its entire thickness;

c3) in the part of the mounting insole 301 opposite the element 311, i.e. that part facing the foot, a reference groove 305 which surrounds said window 303 of meshwork fabric 307 is formed (see FIGS. 21 and 24);

c4) the surface of the mounting insole 301 facing the foot is covered with glue 395, except for the area delimited by the groove 305;

c5) a tubular stocking 360 is prepared (see FIG. 20) using an impermeable and breathable membrane having characteristics identical to those of the membrane 107; the stocking 360 comprises an upper part 389 enveloping the upper part of the foot and a second insole part 390; the two parts 389, 390 are stitched together so as to form the stocking 360 by means of stitches 392 which are then heat-welded in order to prevent water infiltration;

c6) the bottom surface of the tubular stocking 360 in the zone of the insole 390 is covered with glue 395, except for the area indicated by 371 in FIG. 20 (shown in broken lines), this area corresponding substantially to the area delimited by the groove 305 on the insole 301; the stocking 360 and the insole 301 are then glued together;

c7) the tubular stocking 360 made of impermeable and breathable material is applied to an upper 350 (see FIG. 24) by means of a perimetral stitching (not shown) in the zone of the collar, while the bottom edges 351 of the upper 350 are folded over and glued underneath the insole 301;

c8) a reinforcing element 327 obtained by means of injection in a separate mould is applied onto the insole 301 so as to cover/protect at least a part of the edges 351 and a tread sole 312, which comprises a recess zone 399 which surrounds partially the element 111, is applied.

As in the preceding variant, the user's foot rests, preferably by means of an inner sole, on the part 390 of the stocking 360 consisting of the membrane. The penetration of water from outside the shoe with a sole 300 is stopped by the stocking 360 in the membrane part 390 and by the glue 395.

It should be noted again how the structure according to the invention in the shoe with sole 300 produces the effect of pumping the moist air outside the sole 300, as already described with reference to the membrane 117, owing to the fact that the membrane part 390 is not attached to the fabric 307 and may oscillate inside an air chamber 388 above said layer of fabric 307.

Moreover, the impermeable and breathable membrane is applied to the insole 301 after overinjection of the element 311 has been performed and therefore does not risk being damaged by the high temperature during injection. The various gluing steps may be performed by means of spot gluing (spiderweb technique) or spray gluing, so as to reduce to a minimum the risk of damaging the membrane.

Another advantage (present moreover in all three variants described) is that the membrane in the part 390 does not risk tearing with the movements of the foot. In fact, since it may be stitched and/or glued without being tensioned, it may be subject to deformations resulting from movement of the foot without critical stresses.

The protective element 111, 211, 311 may be made of very strong material (necessary, among other things, for protecting the membrane 117, 290, 390), while the tread sole 129, 212, 312 may be very soft (in order to dampen the shocks): the comfort of the shoe according to the invention is significantly improved. Depending on the particular case, it is possible to choose to form the protective element 111, 211, 311 as an additional tread portion in contact with the ground or design it with dimensions such that it does not touch the ground.

Manufacture of the sole according to the invention does not involve particular constructional problems and avoids complicated shapes of the sole, as in EP 1,089,642, which adversely affect the cost and simplicity of production.

The form of the sole 129, 212, 312 may comprise a recess zone 199, 299, 399 such as that which surrounds laterally most of the perforated element 111, 211, 311 or a hole inside which a complementary perforated element such as those indicated by 111, 211, 311 is seated.

The perforated element 111, 211, 311 may comprise openings 113, 213, 313 of varying shape and orientation provided that they allow the moist air from inside the shoe to reach the outside of said shoe. Obviously, it is possible to provide one or more perforated elements 111, 211, 311 which are identical or different, situated closely alongside each other or very spaced.

Figure 26:
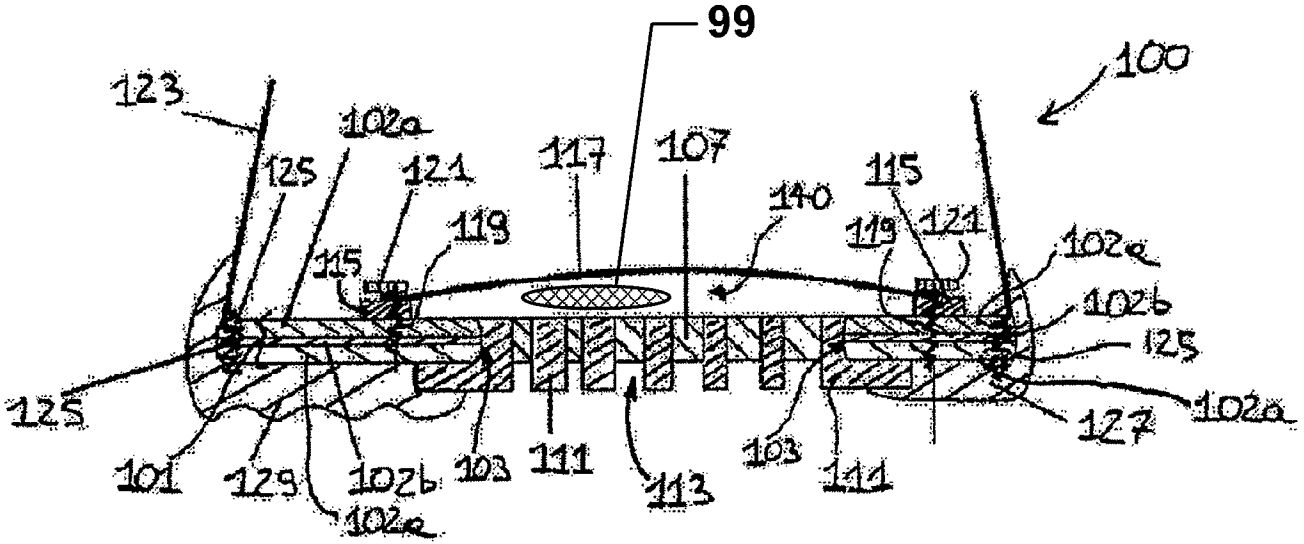
FIG. 26 shows a cross-sectional view along the plane I-I of the sole according to FIG. 8 and part of the associated shoe wherein a breathable element is disposed.

It is possible to insert a soft breathable element 99 (shown in FIG. 26) inside the volume 140, 288, 388 in order to increase the comfort of the foot. Clearly, said element must be made of a porous or meshwork material so as not to reduce the flow of moist air leaving the sole.

For the membrane 207 or the membrane stocking 260, 360 it is possible to use those which are commercially available and which are usually present in the form of a multi-layered sandwich so that they are stronger. Irrespective of the structure of the membrane, the membrane according to the invention may be arranged over the at least one region which allows the air to pass through, simply resting thereon (i.e. loosely) or slightly tensioned, sufficient, for example, for it not to be creased.

Even though, in the three embodiments described, the support layer comprises a region having a material which allows the air to pass through, said material by protecting said region and/or the membrane improving the reliability and the strength of the sole (and the shoe), variations of the invention where said material is absent are possible.

Figure 25:
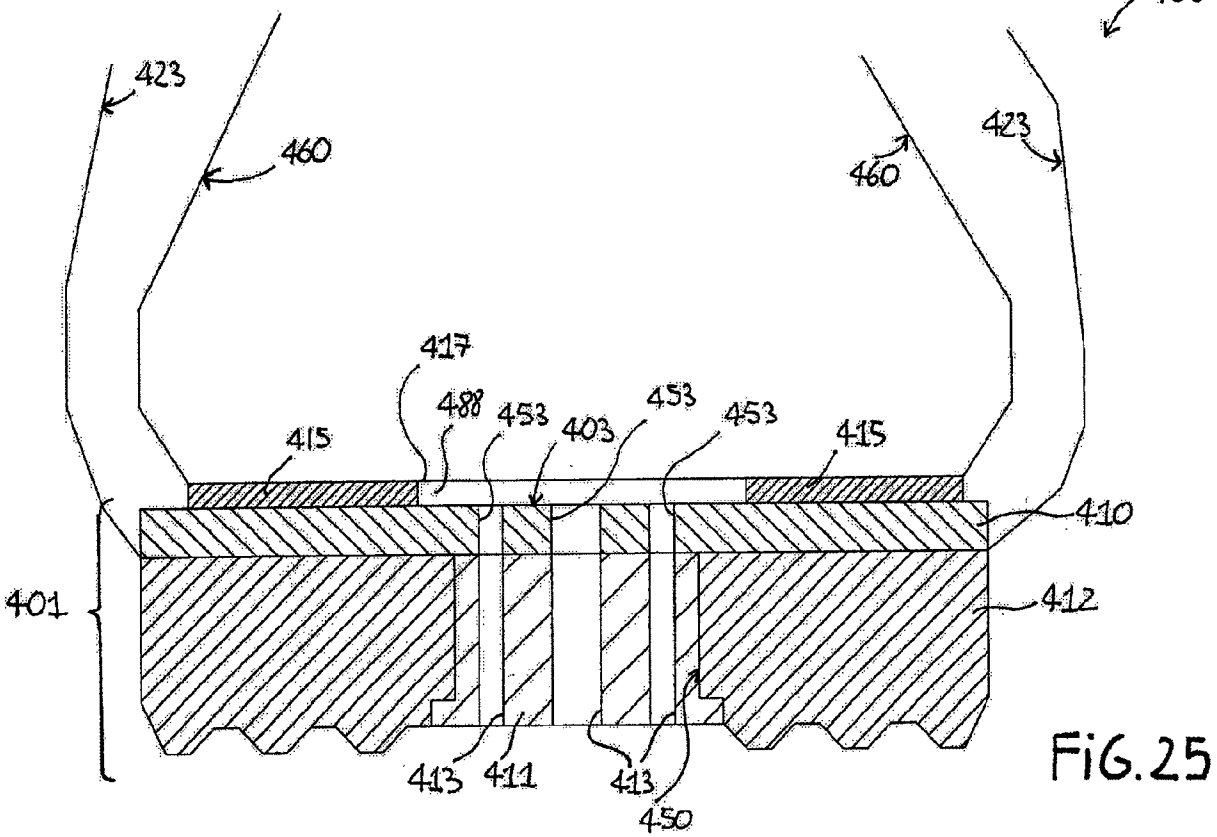
FIG. 25 shows in schematic form a cross-sectional view along a plane vertical and perpendicular to the length of the foot of a fourth finished sole according to the invention.

With reference to FIG. 25, this shows in schematic form a cross-sectional view of a fourth finished sole 400 according to the invention which does not comprise said air-permeable material. The sole 400 comprises a support layer 401 consisting of the combination of an inner sole 410 and a tread 412. The inner sole 410 has a region 403 which allows the passage of the air, in particular through through-channels 453. Said channels emerge on one side inside a hole 450 in the tread 412 and on the other side in an air chamber 488. Said chamber 488 is delimited by a tubular stocking 460 of membrane material 417, contained in an upper 423, and by some glue 415 which seals the stocking 460 on the support layer 401. All the comments made in connection with similar elements in the preceding embodiments are applicable to the stocking 460, the membrane 417 and sealing thereof, and are not repeated here. A reinforcing element 411 (for the tread and/or for the region 403) is inserted inside the hole 450 of the tread 412, said element having through-holes 413 for evacuating the air from inside the shoe 460 which passes through the membrane 417 and the holes 453 of the region 403. The pumping effect described above is also present in this fourth sole 400 which may be subject to all the constructional variants already described above. Obviously the sole 400 may also be provided with a water-proof material which allows the passage of the air, in particular for protection of the membrane 417. For this material it is possible to choose, for example, a meshwork fabric or a membrane made of a material which is waterproof and vapour-permeable. A layer of this material could, for example, be arranged above or underneath the region 403, so as to cover its holes 453, or in the middle of the said region 403, using a technique such as that described for the third sole 300. The reinforcing element 411 must not necessarily extend over the whole thickness of the tread 412, an initial portion extending from the region 403 or from the surface of the tread 412 in contact with the ground being sufficient, for example.

These and other variants are included within the protective scope of the following claims.

The invention claimed is:

1. A sole for an impermeable and breathable shoe, the sole comprising:

a support layer having a first side and a second side, the second side being opposite the first side, the support layer comprising an air-permeable region and comprising an insole, the air-permeable region allowing passage of air through the support layer, the air-permeable region being associated with a meshwork fabric, the insole comprising a water-repellent material;

a reinforcing element joined to the first side of the support layer in the air-permeable region, the reinforcing element comprising at least one through opening for evacuating air that passes through the air-permeable region;

a first membrane disposed above the air-permeable region on the second side of the support layer, the first membrane comprising a waterproof and vapor-permeable material;

an air chamber disposed above the air-permeable region defined by a waterproof seal between the first membrane and the support layer, the seal being disposed along a contour around the air-permeable region, the air chamber being reactive to a wearer of the shoe to force air flow from the air chamber through the air-permeable region and the at least one through opening.

2. The sole of claim 1, wherein the first membrane is unconstrained on the air-permeable region.

3. The sole of claim 1, wherein the seal comprises a spacing element for joining the support layer to the first membrane.

4. The sole of claim 3, wherein the spacing element comprises a rim, the rim being applied onto the support layer along the contour, the first membrane being sealed to the rim on an edge of the rim.

5. The sole of claim 3, further comprising a soft breathable element housed inside the air chamber.

6. The sole of claim 3, wherein the spacing element is a layer of glue.

7. The sole of claim 1, wherein the insole comprises the at least one through opening and further comprises a permeable and breathable fabric disposed onto an edge of the at least one through opening.

8. The sole of claim 1, wherein the support layer comprises an insole on top of a meshwork fabric leaving at least one region of meshwork fabric exposed, the insole comprising a thermoplastic material.

9. The sole of claim 1, wherein the support layer comprises a tread sole, the tread sole comprising a recess zone, the reinforcing element being disposed in the recess zone.

10. The sole of claim 1, wherein the support layer comprises a tread sole, the tread sole comprising an aperture, the at least one through opening being disposed in the aperture.

11. The sole of claim 1, wherein the contour is disposed spaced from the air-permeable region.

12. The sole of claim 1, further comprising a first layer of material for protecting the air-permeable region and permitting the flow of air through the air-permeable region.

13. The sole of claim 12, wherein the first layer covers the air-permeable region.

14. The sole of claim 13, wherein the first layer comprises a meshwork fabric.

15. The sole of claim 12, wherein the first layer comprises a second membrane made of material which is waterproof and vapor-permeable.

16. An impermeable and breathable shoe, the shoe comprising:

a sole comprising a support layer having a first side and a second side, the second side being opposite the first side, the support layer comprising an air-permeable region and comprising an insole, the air-permeable region allowing passage of air through the support layer, the air-permeable region being associated with a meshwork fabric, the insole comprising a water-repellant material;

a reinforcing element joined to the first side of the support layer in the air-permeable region, the reinforcing element comprising at least one through opening for evacuating air that passes through the air-permeable region;

a membrane disposed above the air-permeable region on the second side of the support layer, the membrane comprising a waterproof and vapor-permeable material;

an air chamber disposed above the air-permeable region defined by a waterproof seal between the membrane and the support layer, the seal being disposed along a contour around the air-permeable region, the air chamber being reactive to a wearer of the shoe to force air flow from the air chamber through the air-permeable region and the at least one through opening.

17. The shoe of claim 16, wherein the membrane forms a tubular stocking for receiving the foot and is sealed by a portion of the insole to the support layer at least along a contour around the air permeable region.

18. The shoe of claim 17, wherein the portion of the insole is sealed to the support layer at least along the edge of the rim.

19. The shoe of claim 17, wherein the portion of the insole is sealed to the support layer with glue along at least a contour of the air-permeable region.

20. The shoe of claim 19, further comprising a groove on a surface of support layer, the groove confining the glue to the outside of the contour of the air-permeable region.

* * * * *